US005348371A

United States Patent [19]

Miotto

[11] Patent Number: 5,348,371

[45] Date of Patent: Sep. 20, 1994

[54] MECHANICAL DEVICE FOR USE PARTICULARLY FOR THE SYNCHRONOUS MOVEMENT OF THE SEAT AND BACKREST OF A CHAIR

[75] Inventor: Loris Miotto, Roncade, Italy

[73] Assignee: Shepherd Products U.S., Inc., St. Joseph, Mich.

[21] Appl. No.: 64,739

[22] Filed: May 19, 1993

Related U.S. Application Data

[63] Continuation of Ser. No. 622,860, Dec. 6, 1990, abandoned.

[30] Foreign Application Priority Data

Dec. 14, 1989 [IT] Italy ..... 82624 A/89

[51] Int. Cl.[5] ..... A47C 3/00

[52] U.S. Cl. ..... 297/301; 297/300

[58] Field of Search ..... 297/301, 300, 302, 320, 297/374

[56] References Cited

U.S. PATENT DOCUMENTS 4,629,249 12/1986 Yamaguchi ..... 297/301
4,743,065 5/1988 Meiller et al. ..... 297/301
4,747,640 5/1988 Locher ..... 297/301
4,986,601 1/1991 Inoue ..... 297/301

FOREIGN PATENT DOCUMENTS 0179933 10/1984 European Pat. Off. .
0198056 10/1985 European Pat. Off. .
3724605 2/1989 Fed. Rep. of Germany ..... 297/301

*Primary Examiner*—Kenneth J. Dorner
*Assistant Examiner*—C. Hope Davis
*Attorney, Agent, or Firm*—Lee, Mann, Smith, McWilliams, Sweeney & Ohlson

[57] ABSTRACT

A mechanical device connectable to the upper end of a central column extending from a chair base for the synchronous movement and locking of the seat and backrest of a chair. The device includes a first bracket connected to the column. A second bracket for connection to the seat is pivotally connected to the first bracket by a first axis. A third bracket for connection to the backrest is pivotally connected to the second bracket. A third axis is connected to the first bracket and extends through slots in the third bracket for limiting the rotation thereof. A fourth axis is connected to the second bracket and is connected to the third axis by a plurality of slotted disks. The third axis is operative to selectively lock the disks in a stationary position to prevent pivotal movement of the second and third brackets.

5 Claims, 2 Drawing Sheets

MECHANICAL DEVICE FOR USE PARTICULARLY FOR THE SYNCHRONOUS MOVEMENT OF THE SEAT AND BACKREST OF A CHAIR

This application is a continuation of application Ser. No. 622,860, filed Dec. 6, 1990, abandoned.

SUMMARY

The object of this application is a mechanical device for use particularly for the synchronous movement of the seat and backrest of a chair.

The device consists of a first support bracket at the ends associated to a central column extending from a revolving base and pivotally supported transversely at the ends of a second bracket for fastening to the seat.

This second bracket is pivotally supported at the other end, transversely and eccentrically with respect to the axis of the central column, to a third bracket for securing to the backrest.

The third bracket presents the means for guiding its tilt with respect to the said first and second brackets.

Means are also foreseen for selective blocking of the common position between the said first, second and third brackets.

Advantageously, therefore, means for driving a gas piston associated to the central column, can be foreseen.

Such a mechanical device allows, due to the eccentric pivoting with respect to the axis of the central column of the various brackets, optimal interaction between the movement of the seat and the backrest making it more comfortable for the occupant.

DESCRIPTION

The object of this application is a mechanical device for use particularly for the synchronous movement of a seat and backrest of a chair.

Today there are chairs with the seat and backrest as two separate shells, the two being connected in such a way that, as the backrest inclines, a corresponding movement of the seat occurs along an axis almost parallel to that supporting the chair bottom.

Such type of movement is ergonomically incorrect as pressure is placed on the calves of the chair occupant.

There are also chairs where the seat is fixed, for example with respect to the central column extending from a revolving base, the backrest tilts with respect to the seat.

Even these types of chairs, though, present some inconveniences in that when the backrest inclines, the chair occupant can slide in correspondence to the seat resulting in an incorrect ergonomic position of slightly stretching the body which can lead to numbness of the muscles.

Furthermore, the fact that the seat is fixed with respect to the backrest, at a tilt of the latter, leads to lifting, in correspondence to the occupant's back, of the clothes which is annoying to the occupant.

Other chairs also exist where the connection between the backrest and the seal allows the backrest to rotate, upon lifting of the seat.

Due to the poor ergonomic position, these chairs also, though, cause the inconvenience of creating possible numbness of the muscles and limiting the optimal position of keeping the feet on the floor.

In other chairs, the seat and the backrest are singularly and individually variably adjustable, thus necessitating to effect the blocking of the same in the desired position.

Even these chairs, though, present an inconvenience, in that they are not ergonomic but only anatomical, resulting practically in a rigid chair, depending on the position.

The main objective of the device covered by this application is, therefore, that of eliminating the aforementioned inconveniences in the already existing types of chairs, by excogitating a mechanical device that, once associated to a chair, would permit the occupant to obtain an optimal ergonomic position.

Another important scope of the above-mentioned project is that of coming up with an invention that will permit to obtain a tilt between seat and backrest that would eliminate the typical numbness that the occupant would suffer when sitting for a long time.

One more important scope is that of coming up with an invention that would allow the occupant, when in the working position, to keep the backrest and set in a correct ergonomic position.

Another scope is that of excogitating an invention that would avoid blood compression to the lower arteries.

Another scope is that of coming up with an invention whereby with the rotating of the backrest there would be no so-called "shirt effect", that is the lifting of the clothes.

Still another important scope is that of coming up with an invention that would allow the occupant to keep the feet on the floor, avoiding exerting pressure on the muscles and thus maintaining good blood circulation even during the tilt applicable, for example, to the backrest.

Last, but not least, is the scope of excogitating an invention which, in addition to the preceding characteristics, should have that of being reliable and safe to use as well as structurally simple and cost effective.

The task and the features mentioned above, as well as others which will become clearly apparent later, will be achieved with a mechanical device for use particularly for the synchronous movement of the seat and backrest of a chair, characterized by the fact that it will consist of a first support bracket at the ends, associated to a central column extending from a revolving base and pivotally supported transversely at the end of a second bracket for fastening to the said seat, said second bracket being pivotally supported at the other end, transversely and eccentrically with respect to the axis of the said central column, to a third bracket for securing to the said backrest, this latter having the means of guiding the tilt with respect to said first and second brackets, means also foreseen for the selective blocking of the common position between said first, second and third brackets.

Advantageously, foreseen are means for the activation of a gas piston associated to the said central column.

Further characteristics and advantages of the invention can be found, to a greater degree, in the detailed, but not exclusive description of the device, illustrated as indicated but not limited to the attached drawings.

Figure 1:
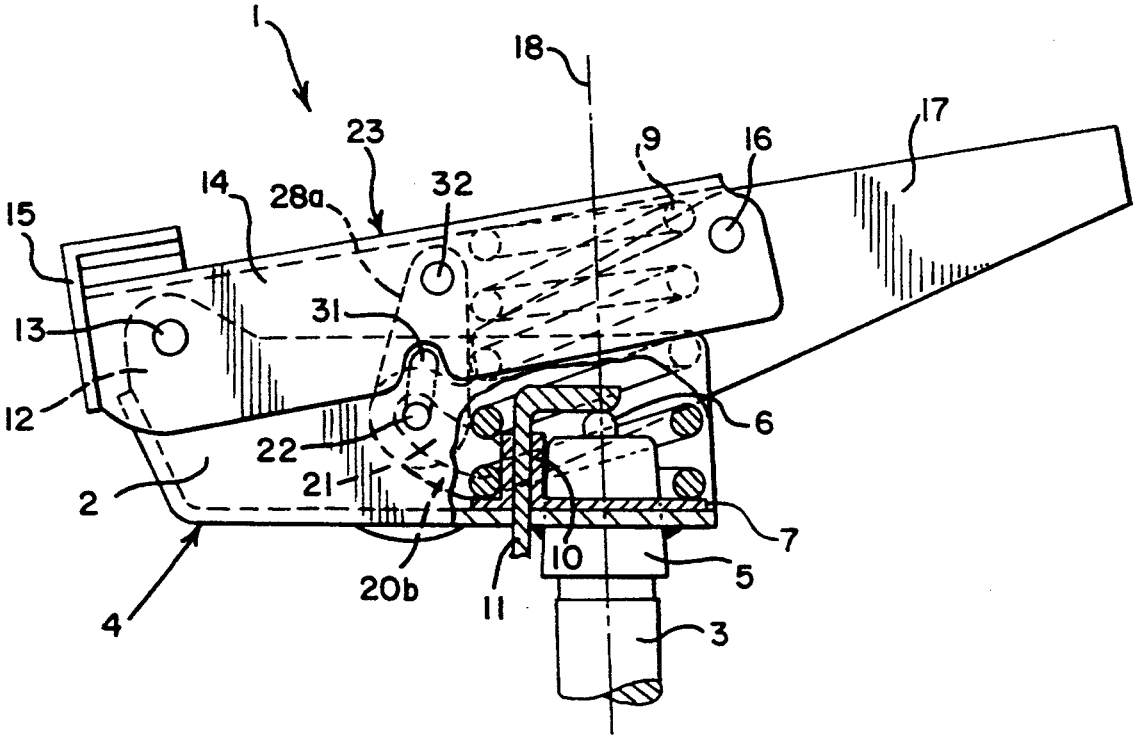
FIG. 1 is a lateral patient sectional view of the mechanical device with the seat and backrest in the forward tilt position.

With reference to the above-mentioned figures, a mechanical device for use particularly for the synchronous movement of the seat and the backrest of a chair, has been indicated with the No. 1.

Such a mechanical device consists of a first support bracket "2" at one end associated to a central column "3" and a pair of vertical walls extending upwardly from opposite sides of the lower surface 4, extending form a revolving base.

The first support bracket "2", in fact, presents an enclosed structure in correspondence to its lower flat surface "4", having a hole for accommodating a buckle "5" associated to the terminal end of the central column "3".

In the case of the column 3, the use of a gas piston "6" is foreseen; concentric to the buckle "5" could be placed a ring "7", advantageously made out of plastic, presenting a circular perimetrical space "8" for an element elastically strained such as a spring "9" as well as a hollow sleeve "10" to hold a shaft "11" to activate the gas piston "6".

Such a shaft "11" would favourably extend transversely and externally to the first support bracket "2" for the occupant to activate.

Hence, the first support bracket "2" would have, at the other end and opposite to the lower flat surface "4", a pair of small wings "12" transversely to which is placed a first axis "13" pivotally supporting the first bracket "2" to a second bracket "14" for securing to the seat.

The second bracket 14 would present a "C" shaped structure eventually with the wings connected, in the proximity of the first axis "13", a beam "15" essentially in the form of an "L", for fastening to the seat. The second bracket 14 includes an upper flat surface and a pair of vertical walls extending downwardly from opposite sides of the upper surface. The downwardly extending walls being located outwardly from and overlapping the vertically extending walls of the first bracket 2.

The second fastening bracket "14" would present a longitudinal extension slightly above that of the first support bracket "2", at the opposite end of the one pivotally supported to the latter, the second fastening bracket "14" would present transversely a second axis "16" pivotally supporting a third bracket "17" for securing to the backrest of the chair.

Due to the dimensions of the first support bracket "2" and of the second fastening bracket "14" it results that, with respect to the axis "18" of the central column, the second axis "16" is disposed eccentrically with respect to the first axis "13" and, in particularly, at a much shorter distance.

The third bracket "17" for securing to the backrest has an end extending past the second bracket "14" for fastening to the seat at the opposite side with respect to the beam "15", where a number of holes are drilled for securing to the backrest.

At the opposite end, the third bracket "17" shows laterally a pair of wings "20*a*" and "20*b*" on each one of which is cut a first curved slit "21".

In each of the said slits "21" is hence placed a third axis "22", pivotally supported, to correspond to the adjacent lateral walls of the first support bracket "2" and the third bracket "17".

Figure 2:
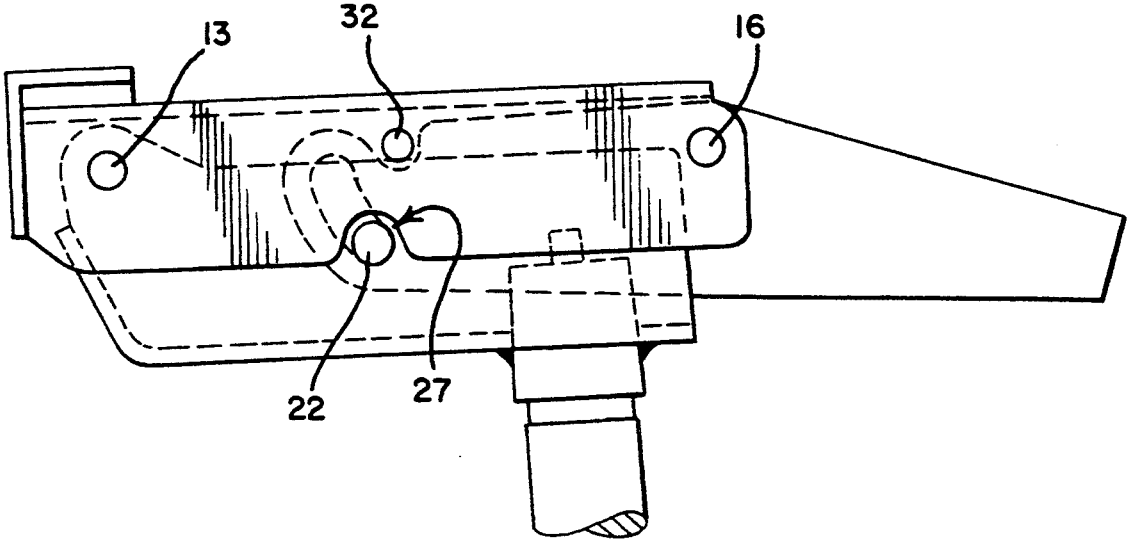
FIG. 2 is an analogous view of the device with the seat and backrest in the backward tilt position.
Figure 3:
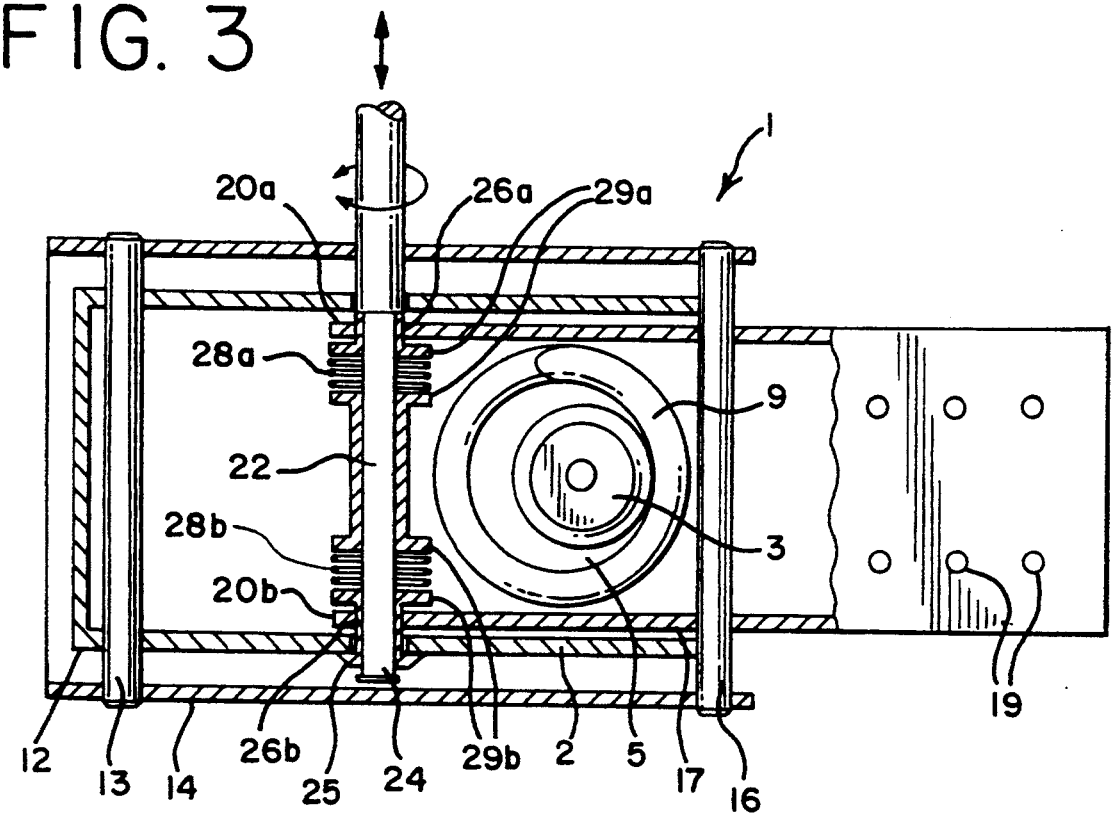
FIG. 3 is a top partial sectional view of the device.
Figure 4:
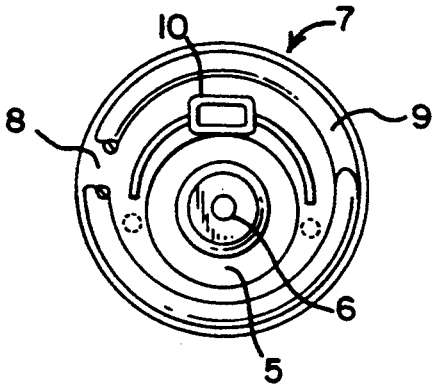
FIG. 4 is a top view of the device with a ring placed concentrically to a buckle present at the end of the central column.
Figure 5:
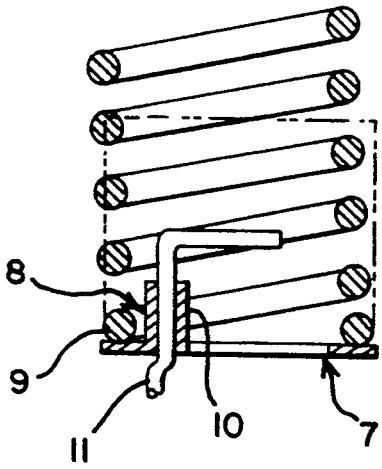
FIG. 5 is a sectional view where the ring mentioned in FIG. 4 is shown with the spring.

In fact, it would seem that the second fastening brackets "14" partially covers the first support bracket "2", and the third bracket "17" would in turn be placed partially inside the first support bracket "2". The downwardly extending walls of the second bracket 15 overlap the entire top edge of the upwardly extending walls of the first bracket 2 in all pivotal positions of the second bracket 14 between its forward tilt position shown in FIG. 1 and its backward tilt position shown in FIG. 2.

Further, the spring "9" makes contact in correspondence to the inner side of the upper lateral surface "23" of the second fastening bracket "14".

The third axis "22" shows a revolving threaded end "24" associated to a counter-threaded first buckle "25" connected externally to the lateral surface of the first support bracket "2".

Naturally, concentrically to the third axis "22" pivotally corresponding to the pair of wings "20*a*" and "20*b*" of the third bracket "17", there is pre-disposed second buckles "26*a*" and "26*b*" which allow for optical pivot support in the absence of friction.

Opposite the threaded end "24", the third axis "22" shows, corresponding to the pivot hole of the lateral wall of the first support bracket, a gradual increase in diameter; in correspondence to the latter, in fact, a slot "27" is cut on the lateral wall of the adjacent second fastening bracket "14".

The pair of wings "20*a*" and "20*b*", together with the third axis "22", constitute the said means for guiding the tilt of the third bracket "17" with respect to the first support bracket "2" and the second fastening bracket "14".

The device further consists of means for selective blocking of the common position between the said first, second and third brackets, such means constituting of a pair of lamellae covers "28*a*" and "28*b*" interposed between pairs of disks "29*a*" and "29*b*" all concentrically disposed to the third axis "22" between the upwardly extending walls of the first bracket 2.

The pairs of disks "29*a*" and "29*b*" are shown solidly connected among themselves by means of a tubular element concentric to the third axis "22".

Advantageously, the lamellae covers "28*a*" and "28*b*" present an irregular elliptic structure with, at one end, a second slit "31" for holding the third axis "22", and at the other end, a hole for supporting to a four axis "32".

Hence, the use of the device would be the following: Inclining of the backrest will result in much less movement of the seat due to the eccentric support of the first and second axis in respect to the axis of the central column.

By rotating the backrest forward, a slight forward rotation of the seat occurs, thus allowing the optimal position of keeping the feed on the floor and good blood circulation to the lower arteries.

Preferably, as for tilt ratio between the angles of rotation attainable for the backrest and the seat, in their synchronous mode, the following are considered the best: The rotation of the seat can vary from plus 7 degrees to minus 3 degrees, while the rotation of the backrest can vary from plug 7 degrees to minus 20 degrees.

With such tilt ratios, when balanced, you can very well see the comfort in the movement of the occupant's back but you cannot see, other than in an imperceptible way, the movement of the seat the bottom part of which moves downward allowing to keep the feet on the floor avoiding exerting pressure on the muscles and hence maintaining good blood circulation.

At the same time, the occupant benefits of the possibility of moving his back and hence changing position or unloading the pressure of the vertebrae to the backrest.

Further, the presence of the third axis "22", which can be activated by means of a predisposed handle by the occupant, permits by slightly turning it, to control the translation of the lamellae covers "28*a*" and "28*b*", until they are completely covered; thus having the various brackets block in the desired position.

Alternatively, the tilt can be left free.

Therefore, it has been established how the invention has achieved the task and the predetermined scopes, having attained a mechanical device that allows the occupant, once the device is associated to a chair, to obtain an optimal ergonomic position with a tilt between the seat and the backrest that will eliminate the typical numbness caused to the occupant as a result of sitting down for a long time.

The mechanical device further allows the occupant to keep, in the working position, the backrest and the seat in the correct ergonomic position as the backrest can be disposed perpendicularly to the support surface of the revolving base and the seat can be slightly bent forward thus facilitating the down-flow of blood to the lower arteries.

In fact, it would be possible to rest the feed on the floor avoiding imposing muscular pressure to the arteries and hence keeping good blood circulation even during the tilt applicable, for example, to the backrest.

Further, the synchronism obtained by the movement of the seat and backrest allows the same to follow, in an optimal way, the occupant's body movement without subjecting him to forces that will interferer with the movements.

Lastly, it is to be pointed out how the mechanical device would be cost efficient, being safe and reliable in its use and resulting also in being structurally simple.

Naturally, the invention is subject to numerous modifications and variations, all falling within the same concept.

Also, the dimensions, as well as the materials of the individual components of the device, could be the most appropriate, depending on the specific needs.

I claim:

1. A mechanical device connectable to an upper end of a central column extending from a chair base for use particularly for synchronous movement of a seat and backrest of a chair, including a first support bracket connectable to the upper end of the central column, said first support bracket including an enclosed lower flat surface and a pair of vertical walls extending upwardly from opposite sides of said lower surface, a second fastening bracket including an upper flat surface and a pair of vertical walls extending downwardly from opposite sides of said upper surface, said downwardly extending walls of said second bracket being located outwardly from and overlapping the entire length of said upwardly extending walls of said first bracket, said second bracket adapted to be connected to the seat, a first axis extending through said upwardly extending walls of said first bracket and through said downwardly extending walls of said second bracket, said first axis pivotally connecting said second bracket to said first bracket for pivotal rotation of said second bracket about said first axis, said first axis being transversely spaced with respect to the central column, a third bracket having a first end adapted to be secured to the backrest and a second end including a pair of slotted apertures, said third bracket being located between said upwardly extending walls of said first bracket, a second axis extending through said downwardly extending walls of said second bracket and through said third bracket, said second axis pivotally connecting said third bracket to said second bracket for pivotal rotation of said third bracket with respect to said second bracket about said second axis, means connected between said first and third brackets for limiting pivotal movement of said third bracket with respect to said first bracket including a third axis extending through said upwardly extending walls of said first bracket and through said slotted apertures of said third bracket, means for the selective locking of said second bracket and said third bracket in a stationary position relative to said first bracket including a plurality of adjacent lamellae covers located between said upwardly extending walls of said first bracket, each cover including an aperture at a first end and a slotted aperture at a second end, and a fourth axis extending through said downwardly extending walls of said second bracket and through said apertures in said first end of said covers, said third axis extending through said slotted apertures in said covers, said third axis being operative to selectively lock said second and third brackets in said stationary position relative to said first bracket, and means for resiliently exerting force against said first and second brackets, said means for exerting force extending between said first and second brackets and located between said second axis and said fourth axis, whereby pivotal movement of said third bracket with respect to said second bracket causes synchronous pivotal movement of said second bracket with respect to said first bracket.

2. The mechanical device of claim 1 additionally including a gas piston attachable to the central column and means for activating said gas piston.

3. The mechanical device of claim 1 wherein said means for exerting a force comprises a spring.

4. The mechanical device of claim 1 wherein said first axis is adapted to be located at a first distance from the axis of the central column and said second axis is adapted to be located at a second distance from the axis of the central column, said first distance being greater than said second distance.

5. The mechanical device of claim 4 wherein said first axis and said second axis are adapted to be located on opposite sides of the axis of the central column.

* * * * *